US007050010B2

(12) United States Patent
Wang et al.

(10) Patent No.: US 7,050,010 B2
(45) Date of Patent: May 23, 2006

(54) DUAL-BAND INVERTED-F ANTENNA WITH SHORTED PARASITIC ELEMENTS

(75) Inventors: Chi-Yueh Wang, Kaohsiung (TW); Boon-Tiong Chua, Kaohsiung (TW); Cheng-Han Lee, Kaohsiung (TW)

(73) Assignee: Yageo Corporation, Kaohsiung (TW)

( * ) Notice: Subject to any disclaimer, the term of this patent is extended or adjusted under 35 U.S.C. 154(b) by 0 days.

(21) Appl. No.: 11/043,623

(22) Filed: Jan. 26, 2005

(65) Prior Publication Data

US 2005/0168384 A1 Aug. 4, 2005

(30) Foreign Application Priority Data

Jan. 30, 2004 (TW) ..... 93102066 A

(51) Int. Cl.
*H01Q 1/24* (2006.01)

(52) U.S. Cl. ..... 343/702; 343/700 MS; 343/846

(58) Field of Classification Search ..... 343/702, 343/700 MS, 846
See application file for complete search history.

(56) References Cited

U.S. PATENT DOCUMENTS

| | | | | |
|---|---|---|---|---|
| 6,812,892 | B1 * | 11/2004 | Tai et al. | 343/700 MS |
| 6,861,986 | B1 * | 3/2005 | Fang et al. | 343/700 MS |
| 2004/0108957 | A1 * | 6/2004 | Umehara et al. | 343/700 MS |
| 2004/0222923 | A1 * | 11/2004 | Erkocevic | 343/700 MS |

* cited by examiner

*Primary Examiner*—Hoang V. Nguyen
(74) *Attorney, Agent, or Firm*—Ladas and Parry LLP

(57) ABSTRACT

The invention relates to a dual-band inverted-F antenna with shorted parasitic elements. The antenna of the invention comprises a ground plane, a first radiating arm placed above an edge of the ground plane, a second radiating arm placed above the edge of the ground plane, a shorting arm with a substantially inverted-L shape for electrically connecting the first radiating arm and the second radiating arm to the ground plane, a shorted parasitic arm placed above the edge of the ground plane, and a feeding coaxial cable for transmitting signals. There is a distance between the shorted parasitic arm and the first radiating arm so as to induce extra capacitive reactance to compensate the inductive reactance induced by inserting the feeding coaxial cable. The present invention is suitable for the wireless local area network (WLAN) applications in the 2.4 GHz (2.4–2.484 GHz) and 5 GHz (5.15–5.35, 5.725–5.875 GHz) bands.

19 Claims, 4 Drawing Sheets

DUAL-BAND INVERTED-F ANTENNA WITH SHORTED PARASITIC ELEMENTS

BACKGROUND OF THE INVENTION

1. Field of the Invention

The present invention relates to a dual-band inverted-F antenna, more particularly, a dual-band inverted-F antenna with shorted parasitic elements.

2. Description of the Related Art

In recent years, wireless communications devices are becoming increasingly popular. The performance of antenna is a key value of the wireless communications devices. The conventional inverted-F antenna can only be operated in a single band of 2.4 GHz or a partial dual-band (including 2.4 GHz and 5.2 GHz or 2.4 GHz and 5.8 GHz). Therefore, the conventional inverted-F antenna cannot be operated totally covering the bands of 2.4 GHz (2.4–2.484 GHz), 5.2 GHz (5.15–5.35 GHz) and 5.8 GHz (5.725–5.875 GHz).

U.S. Pat. No. 6,339,400 B1, entitled "Integrated antenna for laptop application," discloses an inverted-F antenna disposed on a ground plane of a liquid crystal display for a portable computer. However, the inverted-F antenna can only be operated in the 2.4 GHz band, and is not suitable for the 5.2 GHz and the 5.8 GHz bands.

Therefore, it is necessary to provide a dual-band inverted-F antenna as to solve the above problem.

SUMMARY OF THE INVENTION

One objective of the present invention is to provide a dual-band inverted-F antenna with shorted parasitic elements. The dual-band inverted-F antenna of the invention can be operated in the first band covering 2.4 GHz wireless local area network band and the second band covering 5 GHz wireless local area network band (including 5.2 and 5.8 GHz band).

The dual-band inverted-F antenna of the invention comprises: a ground plane having a first short point, a second short point and a ground point; a first radiating arm, formed in an inverted-L shape and disposed above an edge of the ground plane, for inducing a first band, the first radiating arm having a start terminal and an end terminal, the start terminal being vertical to the edge of the ground plane and having a feeding point, the end terminal being an open terminal of the first radiating arm and being parallel to the edge of the ground plane; a second radiating arm, disposed above the edge of the ground plane and being parallel to the edge of the ground plane, for inducing a second band, the second radiating arm having a start terminal and an end terminal, the start terminal of the second radiating arm connected to the start terminal of the first radiating arm, the end terminal being an open terminal of the second radiating arm and extending in a reverse direction extending from the start terminal of the first radiating arm to the end terminal of the first radiating arm; a shorting arm formed in an inverted-L shape and disposed between the first radiating arm and the ground plane, the shorting arm having a first terminal and a second terminal, the first terminal connected to the start terminal of the first radiating arm, the second terminal connected to the first short point and used for electrically connecting the first radiating arm and the second radiating arm to the ground plane; a shorted parasitic arm formed in an inverted-L shape and disposed above the edge of the ground plane, the shorted parasitic arm having a start terminal and an end terminal, the start terminal being vertical to and connected to the second short point, the end terminal extending towards the end terminal of the first radiating arm; and a feeding coaxial cable for transmitting signals, the feeding coaxial cable having a central conductor and an outer grounding layer, the central conductor connected to the feeding point of the start terminal of the first radiating arm, the outer grounding layer connected to the ground point.

According to the invention, the length of the first radiating arm can be adjusted to operate in the first band, and the length of the first radiating arm almost is equal to ¼ of the wavelength of a central frequency of the first band. The length of the second radiating arm can be adjusted to operate in the second band, and the length of the second radiating arm almost is equal to ¼ of the wavelength of a central frequency of the second band.

Besides, a distance between the shorted parasitic arm and the first radiating arm can be adjusted to be smaller than 5 mm so as to induce extra capacitive reactance to compensate the inductive reactance induced by inserting the central conductor of the feeding coaxial cable between the ground plane and the feeding point. Because the inductive reactance will increase when the operated frequency increase, the impedance matching is not good at 5 GHz band. Therefore, the conventional inverted-F antenna can hardly be operated in a suitable frequency width at 5 GHz band. According to the dual-band inverted-F antenna of the invention, the induced extra capacitive reactance can compensate the inductive reactance. Therefore, the dual-band inverted-F antenna of the invention can be operated in the second band with 2 GHz frequency width covering 5 GHz wireless local area network band (including 5.2 and 5.8 GHz band).

DETAILED DESCRIPTION OF THE INVENTION

Figure 1:
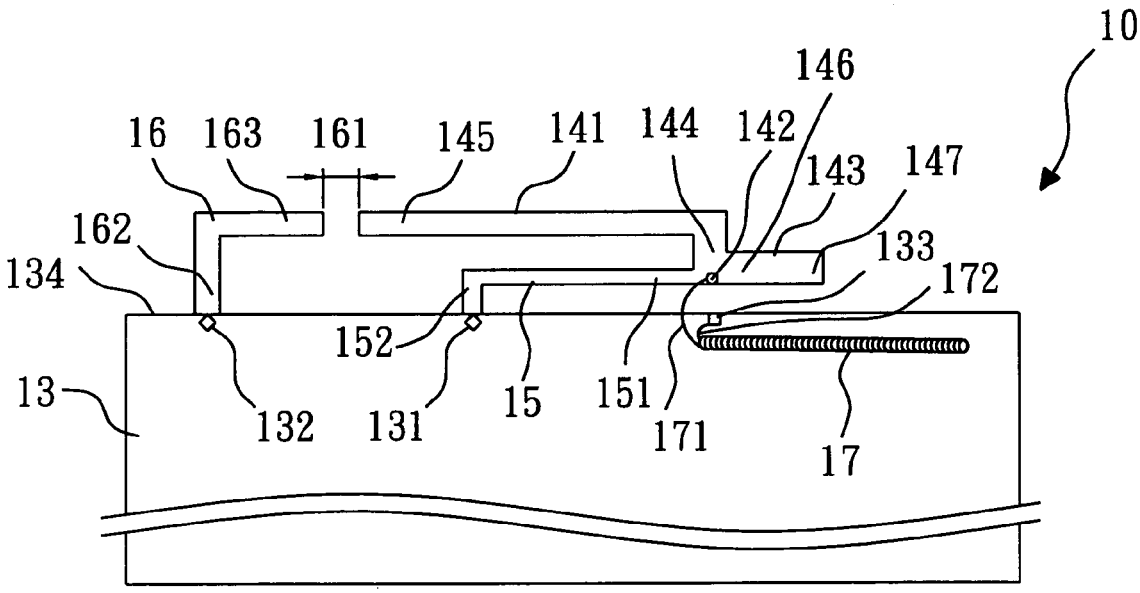
FIG. 1 shows a dual-band inverted-F antenna with shorted parasitic elements, according to a first embodiment of the invention.

Referring to FIG. 1, according to a first embodiment of the invention, a dual-band inverted-F antenna 10 with shorted parasitic elements comprises: a ground plane 13, a first radiating arm 141, a second radiating arm 143, a shorting arm 15, a shorted parasitic arm 16 and a feeding coaxial cable 17. The ground plane 13 is a metal plane or a metal back plane of a liquid crystal display for a portable computer. The ground plane 13 may be of a rectangular shape. The ground plane 13 has a first short point 131, a second short point 132 and a ground point 133, and the first short point 131, the second short point 132 and the ground point 133 are disposed on an edge 134 of the ground plane 13.

The first radiating arm 141 is formed in an inverted-L shape and disposed above the edge 134 of the ground plane 13. The first radiating arm 141 has a start terminal 144 and an end terminal 145. The start terminal 144 is vertical to the edge 134 of the ground plane 13, and has a feeding point 142. The end terminal 145 is an open terminal of the first radiating arm 141 and is parallel to the edge 134 of the ground plane 13. The first radiating arm 141 is used for inducing a first band.

The second radiating arm 143 is disposed above the edge 134 of the ground plane 13 and is parallel to the edge 134 of the ground plane 13. The second radiating arm 143 has a start terminal 146 and an end terminal 147. The start terminal 146 of the second radiating arm 143 is connected to the start terminal 144 of the first radiating arm 141. The end terminal 147 is an open terminal of the second radiating arm 143, and extends in a reverse direction extending from the start terminal 144 of the first radiating arm 141 to the end terminal 145 of the first radiating arm 141. The second radiating arm 143 is used for inducing a second band.

The shorting arm 15 is formed in an inverted-L shape and disposed between the first radiating arm 141 and the ground plane 13. The shorting arm 15 has a first terminal 151 and a second terminal 152. The first terminal 151 is connected to the start terminal 144 of the first radiating arm 141. The second terminal 152 is connected to the first short point 131. The shorting arm 15 is used for electrically connecting the first radiating arm 141 and the second radiating arm 143 to the ground plane 13.

The shorted parasitic arm 16 is formed in an inverted-L shape and disposed above the edge 134 of the ground plane 13. The shorted parasitic arm 16 has a start terminal 162 and an end terminal 163. The start terminal 162 is vertical to and connected to the second short point 132 of the ground plane 13. The end terminal 163 extends towards the end terminal 145 of the first radiating arm 141. There is a distance 161 between the end terminal 163 of the shorted parasitic arm 16 and the end terminal 145 of the first radiating arm 141.

The feeding coaxial cable 17 is used for transmitting signals. The feeding coaxial cable 17 has a central conductor 171 and an outer grounding layer 172. The central conductor 171 is connected to the feeding point 142 of the start terminal 144 of the first radiating arm 141. The outer grounding layer 172 is connected to the ground point 133 of the ground plane 13.

Figure 2:
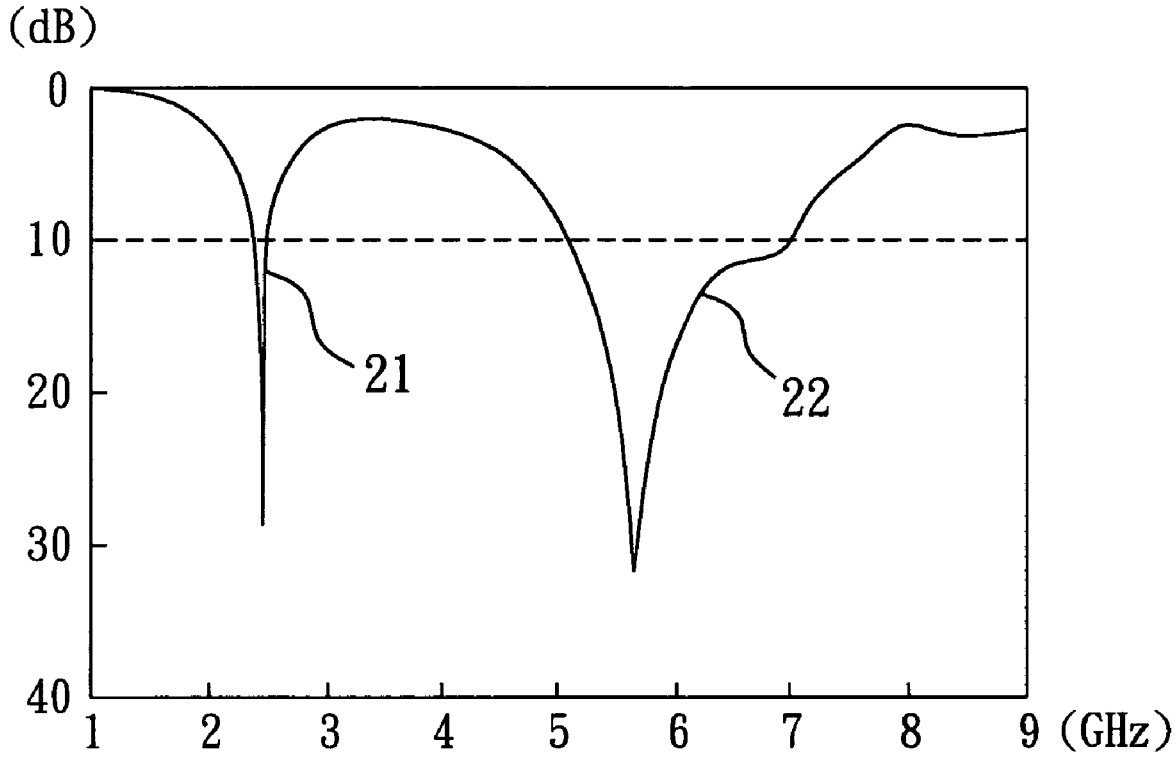
FIG. 2 shows a return loss frequency response chart, according to the first embodiment of the invention.

FIG. 2 shows a return loss frequency response chart according to the first embodiment of the invention. In the first embodiment of the invention, for simulating a metal back plane, the size of the ground plane 13 is determined, and the length of the ground plane 13 is 260 mm and the width of the ground plane 13 is 200 mm. The length of the start terminal 144 of the first radiating arm 141 is 5.5 mm and the width of the start terminal 144 of the first radiating arm 141 is 4 mm. The length of the end terminal 145 of the first radiating arm 141 is 25 mm and the width of the end terminal 145 of the first radiating arm 141 is 2 mm. The length of the second radiating arm 143 is 6 mm and the width of the second radiating arm 143 is 3 mm. The length of the shorting arm 15 is 17.5 mm and the width of the shorting arm 15 is 1 mm. The length of the shorted parasitic arm 16 is 15 mm and the width of the shorted parasitic arm 16 is 2 mm. The distance 161 between the end terminal 163 of the shorted parasitic arm 16 and the end terminal 145 of the first radiating arm 141 is 2 mm.

As a result, when the return loss is smaller than 10 dB, the dual-band inverted-F antenna 10 can be operated in the first band 21 covering 2.4 GHz wireless local area network band (2.4–2.484 GHz) and the second band 22 with 2 GHz frequency width covering 5 GHz wireless local area network band (5.15–5.35 GHz, 5.725–5.875 GHz).

The length of the first radiating arm almost is equal to ¼ of the wavelength of a central frequency of the first band. The length of the second radiating arm is almost equal to ¼ of the wavelength of a central frequency of the second band. The distance between the end terminal of the shorted parasitic arm and the end terminal of the first radiating arm is smaller than 5 mm. The ground plane, the first radiating arm, the second radiating arm, the shorting arm and the shorted parasitic arm can be formed by cutting or pressing a metal plane. Furthermore, the ground plane, the first radiating arm, the second radiating arm, the shorting arm and the shorted parasitic arm can be formed on a microwave substrate by painting or etching technique.

Figure 3:
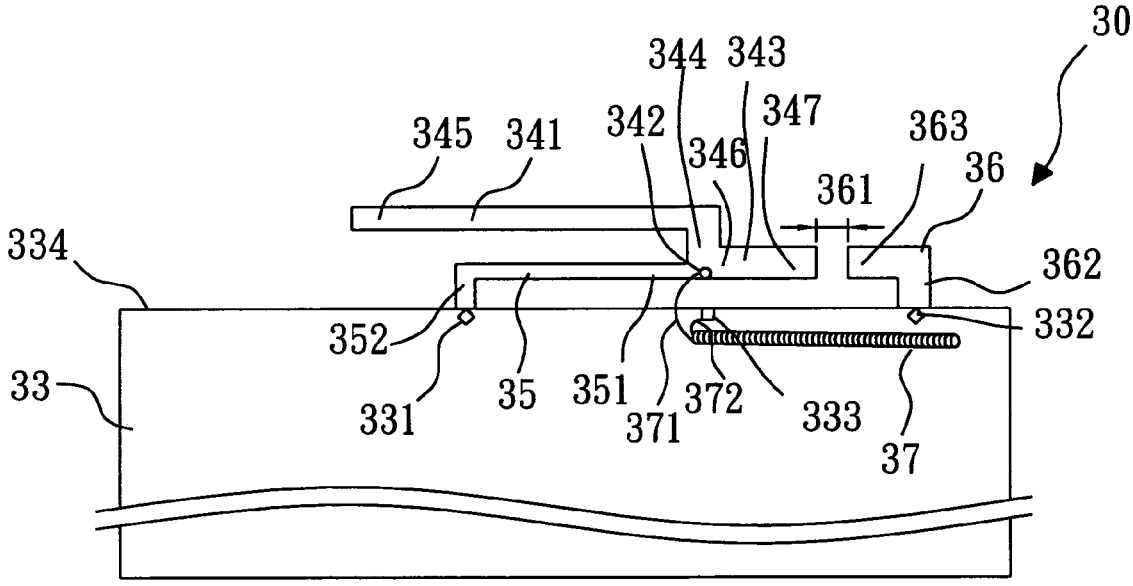
FIG. 3 shows a dual-band inverted-F antenna with shorted parasitic elements, according to a second embodiment of the invention.

Referring to FIG. 3, according to a second embodiment of the invention, a dual-band inverted-F antenna 30 with shorted parasitic elements comprises: a ground plane 33, a first radiating arm 341, a second radiating arm 343, a shorting arm 35, a shorted parasitic arm 36 and a feeding coaxial cable 37. The ground plane 33 is a metal plane or a metal back plane of a liquid crystal display for a portable computer. The ground plane 33 may be a rectangular shape. The ground plane 33 has a first short point 331, a second short point 332 and a ground point 333, and the first short point 331, the second short point 332 and the ground point 333 are disposed on an edge 334 of the ground plane 33.

The first radiating arm 341 is formed in an inverted-L shape and disposed above the edge 334 of the ground plane 33. The first radiating arm 341 has a start terminal 344 and an end terminal 345. The start terminal 344 is vertical to the edge 334 of the ground plane 33, and has a feeding point 342. The end terminal 345 is an open terminal of the first radiating arm 341 and is parallel to the edge 334 of the ground plane 33. The first radiating arm 341 is used for inducing a first band.

The second radiating arm 343 is disposed above the edge 334 of the ground plane 33 and is parallel to the edge 334 of the ground plane 33. The second radiating arm 343 has a start terminal 346 and an end terminal 347. The start terminal 346 of the second radiating arm 343 is connected to the start terminal 344 of the first radiating arm 341. The end terminal 347 is an open terminal of the second radiating arm 343, and extends in a reverse direction extending from the start terminal 344 of the first radiating arm 341 to the end terminal 345 of the first radiating arm 341. The second radiating arm 343 is used for inducing a second band.

The shorting arm 35 is formed in an inverted-L shape and disposed between the first radiating arm 341 and the ground plane 33. The shorting arm 35 has a first terminal 351 and a second terminal 352. The first terminal 351 is connected to the start terminal 344 of the first radiating arm 341. The second terminal 352 is connected to the first short point 331. The shorting arm 35 is used for electrically connecting the first radiating arm 341 and the second radiating arm 343 to the ground plane 33.

The shorted parasitic arm 36 is formed in an inverted-L shape and disposed above the edge 334 of the ground plane 33. The shorted parasitic arm 36 has a start terminal 362 and an end terminal 363. The start terminal 362 is vertical to and connected to the second short point 332 of the ground plane 33. The end terminal 363 extends towards the end terminal 347 of the second radiating arm 343. There is a distance 361 between the end terminal 363 of the shorted parasitic arm 36 and the end terminal 347 of the second radiating arm 343.

The feeding coaxial cable 37 is used for transmitting signals. The feeding coaxial cable 37 has a central conductor 371 and an outer grounding layer 372. The central conductor 371 is connected to the feeding point 342 of the start terminal 344 of the first radiating arm 341. The outer grounding layer 372 is connected to the ground point 333 of the ground plane 33.

In the second embodiment, the dual-band inverted-F antenna 30 can be operated in the first band covering 2.4 GHz wireless local area network band. Besides, the shorted parasitic arm 36 and the second radiating arm 343 can induce extra capacitive reactance to compensate the inductive reactance induced by inserting the central conductor 371 of the feeding coaxial cable 37 between the ground plane 33 and the feeding point 342. Therefore, the dual-band inverted-F antenna 30 can be operated in the second band covering 5 GHz wireless local area network band (including 5.2 and 5.8 GHz band).

The length of the first radiating arm is almost equal to ¼ of the wavelength of a central frequency of the first band. The length of the second radiating arm almost is equal to ¼ of the wavelength of a central frequency of the second band. The distance between the end terminal of the shorted parasitic arm and the end terminal of the second radiating arm is smaller than 5 mm. The ground plane, the first radiating arm, the second radiating arm, the shorting arm and the shorted parasitic arm can be formed by cutting or pressing a metal plane. Furthermore, the ground plane, the first radiating arm, the second radiating arm, the shorting arm and the shorted parasitic arm can be formed on a microwave substrate by painting or etching technique.

Figure 4:
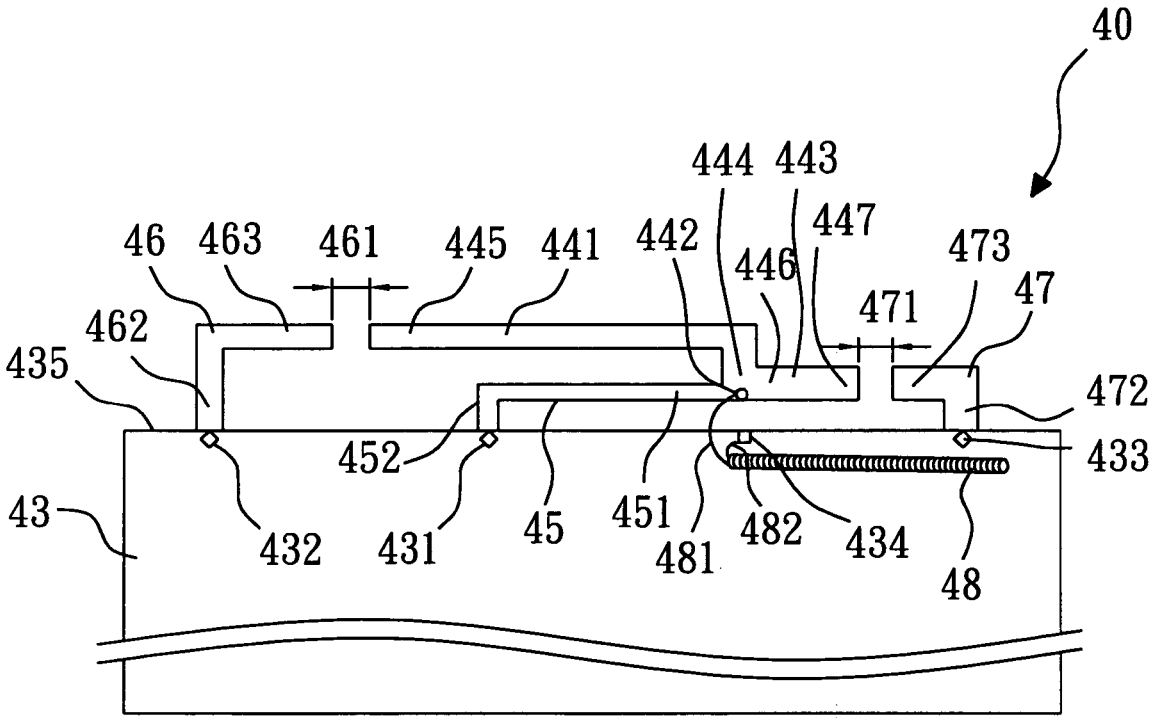
FIG. 4 shows a dual-band inverted-F antenna with shorted parasitic elements, according to a third embodiment of the invention.

Referring to FIG. 4, according to a third embodiment of the invention, a dual-band inverted-F antenna 40 with shorted parasitic elements comprises: a ground plane 43, a first radiating arm 441, a second radiating arm 443, a shorting arm 45, a first shorted parasitic arm 46, a second shorted parasitic arm 47 and a feeding coaxial cable 48. The ground plane 43 is a metal plane or a metal back plane of a liquid crystal display for a portable computer. The ground plane 43 may be a rectangular shape. The ground plane 43 has a first short point 431, a second short point 432, a third short point 433 and a ground point 434. The first short point 431, the second short point 432, the third short point 433 and the ground point 434 are disposed on an edge 435 of the ground plane 43.

The first radiating arm 441 is formed in an inverted-L shape and disposed above the edge 435 of the ground plane 43. The first radiating arm 441 has a start terminal 444 and an end terminal 445. The start terminal 444 is vertical to the edge 435 of the ground plane 43, and has a feeding point 442. The end terminal 445 is an open terminal of the first radiating arm 441 and is parallel to the edge 435 of the ground plane 43. The first radiating arm 441 is used for inducing a first band.

The second radiating arm 443 is disposed above the edge 435 of the ground plane 43 and is parallel to the edge 435 of the ground plane 43. The second radiating arm 443 has a start terminal 446 and an end terminal 447. The start terminal 446 of the second radiating arm 443 is connected to the start terminal 444 of the first radiating arm 441. The end terminal 447 is an open terminal of the second radiating arm 443, and extends in a reverse direction extending from the start terminal 444 of the first radiating arm 441 to the end terminal 445 of the first radiating arm 441. The second radiating arm 443 is used for inducing a second band.

The shorting arm 45 is formed in an inverted-L shape and disposed between the first radiating arm 441 and the ground plane 43. The shorting arm 45 has a first terminal 451 and a second terminal 452. The first terminal 451 is connected to the start terminal 444 of the first radiating arm 441. The second terminal 452 is connected to the first short point 431. The shorting arm 45 is used for electrically connecting the first radiating arm 441 and the second radiating arm 443 to the ground plane 43.

The first shorted parasitic arm 46 is formed in an inverted-L shape and disposed above the edge 435 of the ground plane 43. The first shorted parasitic arm 46 has a start terminal 462 and an end terminal 463. The start terminal 462 is vertical to and connected to the second short point 432 of the ground plane 43. The end terminal 463 extends towards the end terminal 445 of the first radiating arm 441. There is a distance 461 between the end terminal 463 of the first shorted parasitic arm 46 and the end terminal 445 of the first radiating arm 441.

The second shorted parasitic arm 47 is formed in an inverted-L shape and disposed above the edge 435 of the ground plane 43. The second shorted parasitic arm 47 has a start terminal 472 and an end terminal 473. The start terminal 472 is vertical to and connected to the third short point 433 of the ground plane 43. The end terminal 473 extends towards the end terminal 447 of the second radiating arm 443. There is a distance 471 between the end terminal 473 of the second shorted parasitic arm 47 and the end terminal 447 of the second radiating arm 443.

The feeding coaxial cable 48 is used for transmitting signals. The feeding coaxial cable 48 has a central conductor 481 and an outer grounding layer 482. The central conductor 481 is connected to the feeding point 442 of the start terminal 444 of the first radiating arm 441. The outer grounding layer 482 is connected to the ground point 434 of the ground plane 43.

In the third embodiment, the dual-band inverted-F antenna 40 can be operated in the first band covering 2.4 GHz wireless local area network band. Besides, the first shorted parasitic arm 46 and the first radiating arm 441 can induce extra capacitive reactance, and the second shorted parasitic arm 47 and the second radiating arm 443 can also induce extra capacitive reactance so as to together compensate the inductive reactance induced by inserting the central conductor 481 of the feeding coaxial cable 48 between the ground plane 43 and the feeding point 442. Therefore, the dual-band inverted-F antenna 40 can be operated in the second band covering 5 GHz wireless local area network band (including 5.2 and 5.8 GHz band).

The length of the first radiating arm is almost equal to ¼ of the wavelength of a central frequency of the first band. The length of the second radiating arm almost is equal to ¼ of the wavelength of a central frequency of the second band. The distance between the end terminal of the first shorted parasitic arm and the end terminal of the first radiating arm is smaller than 5 mm, and the distance between the end terminal of the second shorted parasitic arm and the end terminal of the second radiating arm is smaller than 5 mm. The ground plane, the first radiating arm, the second radiating arm, the shorting arm, the first shorted parasitic arm and the second shorted parasitic arm can be formed by cutting or pressing a metal plane. Furthermore, the ground plane, the first radiating arm, the second radiating arm, the shorting arm, the first shorted parasitic arm and the second shorted parasitic arm can be formed on a microwave substrate by painting or etching technique.

While an embodiment of the present invention has been illustrated and described, various modifications and improvements can be made by those skilled in the art. The embodiment of the present invention is therefore described in an illustrative, but not restrictive, sense. It is intended that the present invention may not be limited to the particular forms as illustrated, and that all modifications which maintain the spirit and scope of the present invention are within the scope as defined in the appended claims.

What is claimed is:

1. A dual-band inverted-F antenna with shorted parasitic elements, comprising:

a ground plane, having a first short point, a second short point and a ground point;

a first radiating arm, formed in an inverted-L shape and disposed above an edge of the ground plane, the first radiating arm used for inducing a first band, the first radiating arm having a start terminal and an end terminal, the start terminal being vertical to the edge of the ground plane and having a feeding point, the end terminal being an open terminal of the first radiating arm and being parallel to the edge of the ground plane;

a second radiating arm, disposed above the edge of the ground plane and being parallel to the edge of the ground plane, the second radiating arm used for inducing a second band, the second radiating arm having a start terminal and an end terminal, the start terminal of the second radiating arm connected to the start terminal of the first radiating arm, the end terminal being an open terminal of the second radiating arm and extending in a reverse direction extending from the start terminal of the first radiating arm to the end terminal of the first radiating arm;

a shorting arm, formed in an inverted-L shape and disposed between the first radiating arm and the ground plane, the shorting arm having a first terminal and a second terminal, the first terminal connected to the start terminal of the first radiating arm, the second terminal connected to the first short point, the shorting arm used for electrically connecting the first radiating arm and the second radiating arm to the ground plane;

a shorted parasitic arm, formed in an inverted-L shape and disposed above the edge of the ground plane, the shorted parasitic arm having a start terminal and an end terminal, the start terminal being vertical to and connected to the second short point, the end terminal of the shorted parasitic arm extending towards the end terminal of the first radiating arm; and a feeding coaxial cable, for transmitting signals, the feeding coaxial cable having a central conductor and an outer grounding layer, the central conductor connected to the feeding point of the start terminal of the first radiating arm, the outer grounding layer connected to the ground point.

2. The dual-band inverted-F antenna according to claim 1, wherein the length of the first radiating arm almost is equal to ¼ of the wavelength of a central frequency of the first band.

3. The dual-band inverted-F antenna according to claim 1, wherein the length of the second radiating arm almost is equal to ¼ of the wavelength of a central frequency of the second band.

4. The dual-band inverted-F antenna according to claim 1, wherein a distance between the end terminal of the shorted parasitic arm and the end terminal of the first radiating arm is smaller than 5 mm.

5. The dual-band inverted-F antenna according to claim 1, wherein the ground plane, the first radiating arm, the second radiating arm, the shorting arm and the shorted parasitic arm are formed by cutting or pressing a metal plane.

6. The dual-band inverted-F antenna according to claim 1, wherein the ground plane, the first radiating arm, the second radiating arm, the shorting arm and the shorted parasitic arm are formed on a microwave substrate by painting or etching technique.

7. A dual-band inverted-F antenna with shorted parasitic elements, comprising:

a ground plane, having a first short point, a second short point and a ground point;

a first radiating arm, formed in an inverted-L shape and disposed above an edge of the ground plane, the first radiating arm used for inducing a first band, the first radiating arm having a start terminal and an end terminal, the start terminal being vertical to the edge of the ground plane and having a feeding point, the end terminal being an open terminal of the first radiating arm and being parallel to the edge of the ground plane;

a second radiating arm, disposed above the edge of the ground plane and being parallel to the edge of the ground plane, the second radiating arm used for inducing a second band, the second radiating arm having a start terminal and an end terminal, the start terminal of the second radiating arm connected to the start terminal of the first radiating arm, the end terminal being an open terminal of the second radiating arm and extending in a reverse direction extending from the start terminal of the first radiating arm to the end terminal of the first radiating arm;

a shorting arm, formed in an inverted-L shape and disposed between the first radiating arm and the ground plane, the shorting arm having a first terminal and a second terminal, the first terminal connected to the start terminal of the first radiating arm, the second terminal connected to the first short point, the shorting arm used for electrically connecting the first radiating arm and the second radiating arm to the ground plane;

a shorted parasitic arm, formed in an inverted-L shape and disposed above the edge of the ground plane, the shorted parasitic arm having a start terminal and an end terminal, the start terminal being vertical to and connected to the second short point, the end terminal of the shorted parasitic arm extending towards the end terminal of the second radiating arm; and a feeding coaxial cable, for transmitting signals, the feeding coaxial cable having a central conductor and an outer grounding layer, the central conductor connected to the feeding point of the start terminal of the first radiating arm, the outer grounding layer connected to the ground point.

8. The dual-band inverted-F antenna according to claim 7, wherein the length of the first radiating arm almost is equal to ¼ of the wavelength of a central frequency of the first band.

9. The dual-band inverted-F antenna according to claim 7, wherein the length of the second radiating arm almost is equal to ¼ of the wavelength of a central frequency of the second band.

10. The dual-band inverted-F antenna according to claim 7, wherein a distance between the end terminal of the shorted parasitic arm and the end terminal of the first radiating arm is smaller than 5 mm.

11. The dual-band inverted-F antenna according to claim 7, wherein the ground plane, the first radiating arm, the second radiating arm, the shorting arm and the shorted parasitic arm are formed by cutting or pressing a metal plane.

12. The dual-band inverted-F antenna according to claim 7, wherein the ground plane, the first radiating arm, the second radiating arm, the shorting arm and the shorted parasitic arm are formed on a microwave substrate by painting or etching technique.

13. A dual-band inverted-F antenna with shorted parasitic elements, comprising:

a ground plane, having a first short point, a second short point, a third short point and a ground point;

a first radiating arm, formed in an inverted-L shape and disposed above an edge of the ground plane, the first radiating arm used for inducing a first band, the first radiating arm having a start terminal and an end terminal, the start terminal being vertical to the edge of the ground plane and having a feeding point, the end terminal being an open terminal of the first radiating arm and being parallel to the edge of the ground plane;

a second radiating arm, disposed above the edge of the ground plane and being parallel to the edge of the ground plane, the second radiating arm used for inducing a second band, the second radiating arm having a start terminal and an end terminal, the start terminal of the second radiating arm connected to the start terminal of the first radiating arm, the end terminal being an open terminal of the second radiating arm and extending in a reverse direction extending from the start terminal of the first radiating arm to the end terminal of the first radiating arm;

a shorting arm, formed in an inverted-L shape and disposed between the first radiating arm and the ground plane, the shorting arm having a first terminal and a second terminal, the first terminal connected to the start terminal of the first radiating arm, the second terminal connected to the first short point, the shorting arm used for electrically connecting the first radiating arm and the second radiating arm to the ground plane;

a first shorted parasitic arm, formed in an inverted-L shape and disposed above the edge of the ground plane, the first shorted parasitic arm having a start terminal and an end terminal, the start terminal being vertical to and connected to the second short point, the end terminal of the first shorted parasitic arm extending towards the end terminal of the first radiating arm;

a second shorted parasitic arm, formed in an inverted-L shape and disposed above the edge of the ground plane, the second shorted parasitic arm having a start terminal and an end terminal, the start terminal being vertical to and connected to the third short point, the end terminal of the second shorted parasitic arm extending towards the end terminal of the second radiating arm; and a feeding coaxial cable, for transmitting signals, the feeding coaxial cable having a central conductor and an outer grounding layer, the central conductor connected to the feeding point of the start terminal of the first radiating arm, the outer grounding layer connected to the ground point.

14. The dual-band inverted-F antenna according to claim 13, wherein the length of the first radiating arm almost is equal to ¼ of the wavelength of a central frequency of the first band.

15. The dual-band inverted-F antenna according to claim 13, wherein the length of the second radiating arm almost is equal to ¼ of the wavelength of a central frequency of the second band.

16. The dual-band inverted-F antenna according to claim 13, wherein a distance between the end terminal of the first shorted parasitic arm and the end terminal of the first radiating arm is smaller than 5 mm.

17. The dual-band inverted-F antenna according to claim 13, wherein a distance between the end terminal of the second shorted parasitic arm and the end terminal of the second radiating arm is smaller than 5 mm.

18. The dual-band inverted-F antenna according to claim 13, wherein the ground plane, the first radiating arm, the second radiating arm, the shorting arm, the first shorted parasitic arm and the second shorted parasitic arm are formed by cutting or pressing a metal plane.

19. The dual-band inverted-F antenna according to claim 13, wherein the ground plane, the first radiating arm, the second radiating arm, the shorting arm, the first shorted parasitic arm and the second shorted parasitic arm are formed on a microwave substrate by painting or etching technique.

* * * * *